United States Patent [19]

Kelly

[11] 4,102,009

[45] Jul. 25, 1978

[54] ROLLER ASSEMBLY FOR SLIDING DOORS AND WINDOWS

[76] Inventor: Donald V. Kelly, 15903 Condor Ridge Rd., Canyon County, Calif. 91351

[21] Appl. No.: 779,475

[22] Filed: Mar. 21, 1977

[51] Int. Cl.[2] ..... E05D 13/02

[52] U.S. Cl. ..... 16/100; 16/105

[58] Field of Search ..... 16/19, 34, 100, 105, 16/99, 18, 45, 98; 49/420, 425

[56] References Cited

U.S. PATENT DOCUMENTS

| | | | |
|---|---|---|---|
| 2,853,732 | 9/1958 | Matter | 16/19 X |
| 2,980,947 | 4/1961 | Rust et al. | 16/100 X |
| 3,442,052 | 5/1969 | Levine | 49/425 |
| 3,613,313 | 10/1971 | Helmick | 49/420 |
| 3,827,104 | 8/1974 | Lambertz | 16/105 X |

*Primary Examiner*—Dorsey Newton
*Attorney, Agent, or Firm*—John E. Wagner

[57] ABSTRACT

A simple, adjustable roller assembly for supporting sliding track doors and windows and comprising a U shaped bracket which journals a roller and includes a corner opposite from the journaled roller which engages the intersection between the stile and rail of a door frame. An adjusting screw passes through the stile or rail and engages the U shaped bracket whereby tightening of the screw pivots the bracket and roller into increasing downward movement by pivoting the bracket with respect to the inside corner defined by the junction of the stile and rail. In one alternate embodiment, a single screw adjusts a pair of side by side rollers journaled on a common shaft. In another embodiment the U shaped member includes a tap member extendable outward and securable at a spaced point on the door rail or sill. Tightening of this screw serves to bend the tab member and adjust the roller position. The bendable tab actually provides a degree of spring support for the door.

2 Claims, 13 Drawing Figures

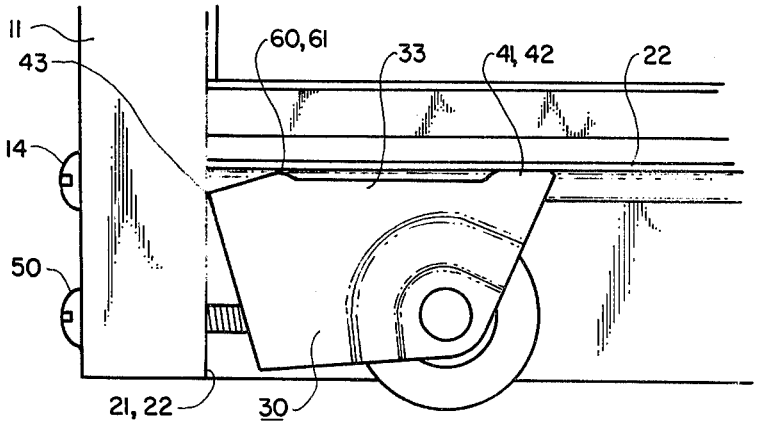
FIG. 3
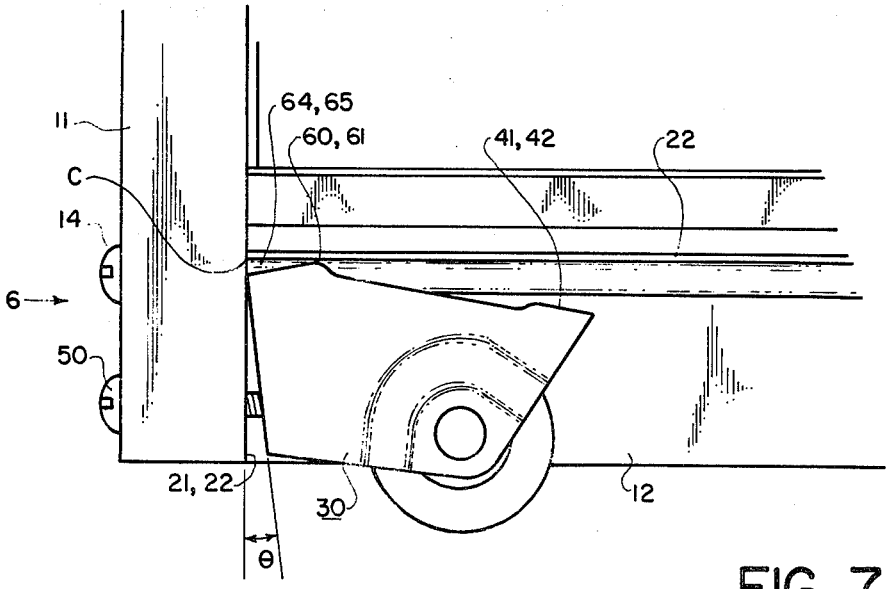
FIG. 4
FIG. 6
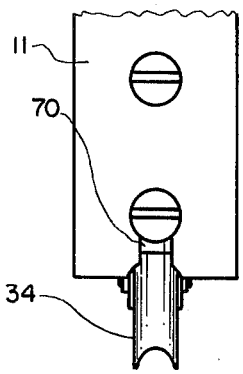
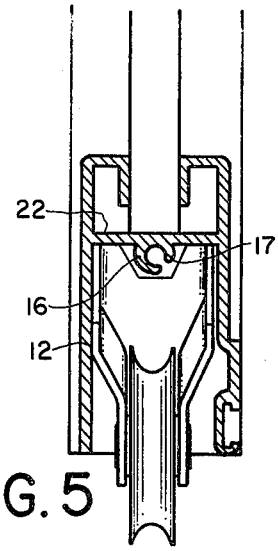
FIG. 5
FIG. 7
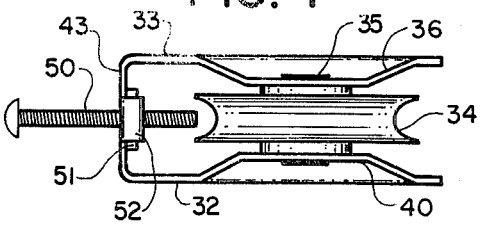
FIG. 8
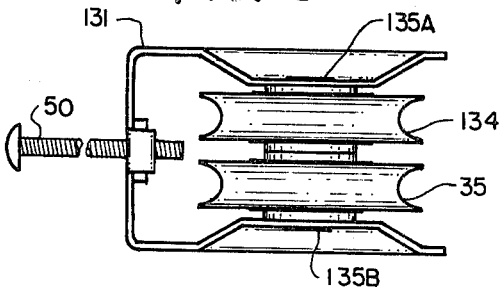

ROLLER ASSEMBLY FOR SLIDING DOORS AND WINDOWS

BACKGROUND OF THE INVENTION

The horizontal sliding glass door and window have achieved a high degree of acceptance particularly in warmer climates providing large expanses of open wall and easy opening and closing. Typically sliding doors and windows have a frame with an upstanding rib on the sill on which concealed rollers within the door or window rail ride. Typically these roller assemblies include a pair of plates spaced in side by side relationship secured to the door frame and an adjustable yoke carrying a journaled roller and some screw means to adjust the yoke with respect to the roller assembly plates. In another form of prior art adjustable roller assembly, a pair of wedges are interposed between the side plates and above the roller to move the entire assembly in its working direction for roller height adjustment.

In each of these types of adjustable roller assemblies, a large number of parts are required. Also the common interfitting arrangement of the roller yoke within and encompassing the body provides an opportunity for jamming, either due to loading or distortion or to accummulated debris. In general, the dividing of the adjustable feature into two or more parts has necessitated the addition of at least one fabricated metal part in addition to the roller holding frame or yoke with a resultant substantial increase in cost.

BRIEF STATEMENT OF THE INVENTION

I have discovered that ultimate simplicity in the design of an adjustable roller assembly may be accomplished by a simple U shaped member journalling a roller and including a corner section spaced from the roller which acts as a fulcrum for the adjustment of the roller by pivotal movement about the corner which remains relatively fixed with respect to inside corner defined by the rail and stile of the door or window frame.

In another embodiment, a U shaped member supporting a journaled roller and including an outward extending tab extending generally normal to the axis of rotation of the roller and including attachment means to be secured to the frame or stile. The U shaped member includes means for engaging a screw passing through the stile of the door or window whereby tightening of the screw deforms the tab and thus changes the elevation of the roller. Thereafter the tab acts as a slight resilient support for the door or window.

BRIEF DESCRIPTION OF THE DRAWING

This invention may be more clearly understood from the following detailed description and by reference to the drawing in which:

FIG. 3 is a side elevational view of the door assembly incorporating this invention partially in section;

FIG. 4 is a view similar to FIG. 3 with the roller assembly adjusted to a lower position;

FIG. 5 is an end view of the assembly of FIG. 4 viewed in the direction of the arrow 5 in FIG. 4;

FIG. 6 is an end view taken in the direction of arrow 6 of FIG. 4;

FIG. 7 is a bottom view of the roller assembly of this invention;

FIG. 8 is a bottom view of an alternate embodiment of this invention employing a double roller;

DETAILED DESCRIPTION OF THE INVENTION

In the need to simplify roller assemblies, I have proceeded with the philosophy that elimination of unnecessary parts not only reduces the cost of roller assemblies but may additionally increase their utility and their reliability. I have found it possible to reduce the number of parts in the roller assembly to basically a U shaped frame, an adjusting screw and possibly a mating nut, and a roller and roller shaft. I employ the actual door rail and stile as working elements in combination with the roller assembly to hold the roller assembly in position and to aid in its adjustability. Operating under this philosophy, the adjusting screw which extends through one of the two frame members, e.g. the stile, makes adjustment from the exterior of the door easily accomplished as well.

Figure 1:
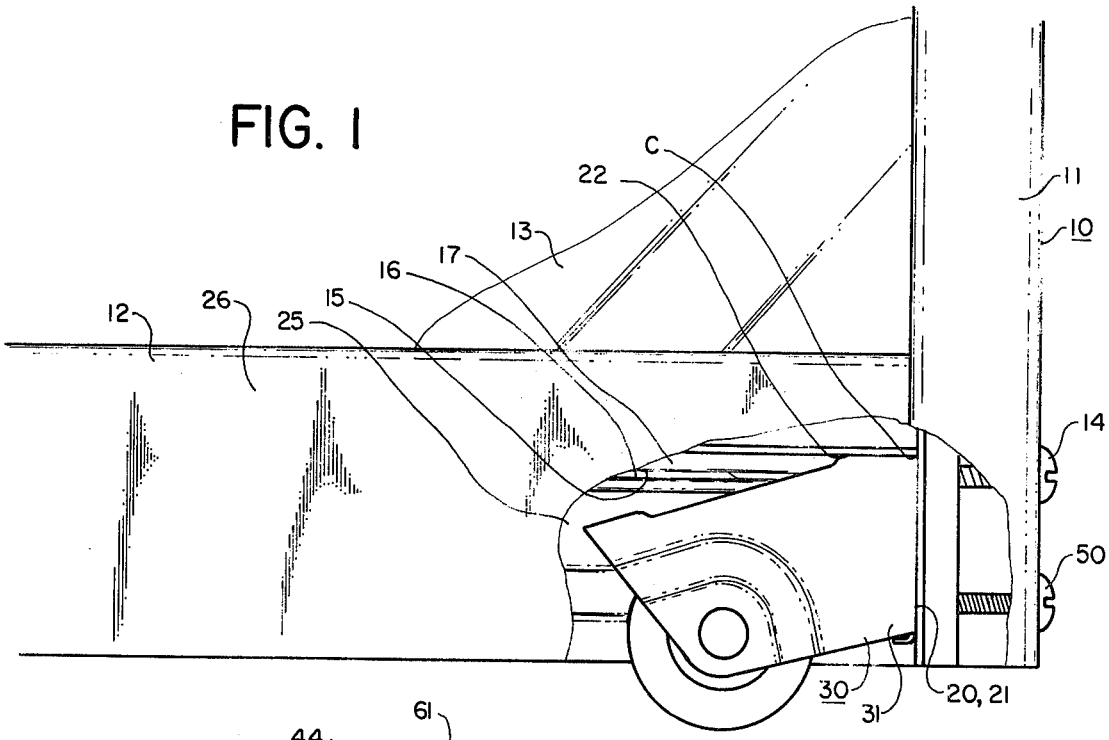
FIG. 1 is a fragmentary side elevational view of a lower corner of a door in accordance with this invention with portions of the rail and stile broken away to reveal the roller assembly of this invention therein.

Now referring to FIG. 1, we may see illustrating this invention a fragmentary lower corner of the sliding glass door generally designated 10 including a stile 11, a rail 12 and a lite 13, all held together by a number of fasteners such as screw 14 which extends through the stile 11 and into a screw groove 15 defined by a pair of curved ribs 16 and 17 appearing in FIG. 1 but better seen in FIG. 5. The use of a screw fastener 14 and the rib 16 and 17 to hold a corner of a door together is well known in the art and is not involved per se in this invention except that in joining the stile 11 and the rail 12, defines a right angular corner "C" at the intersection of vertical ribs 20 and 21 of the stile 11, one of which appears in FIG. 1, and a horizontal web 22 which constitutes the main interconnecting web of the rail 12 as best seen in FIG. 5.

The front and rear walls 25 and 26 respectively of the rail 12 and the web 22 define a rectangular cavity closed at each end by ribs such as 20 and 21 of the stile 11 and its counterpart at the opposite end. In a typical example, the cavity defined by the walls 25 and 26 and the web 22 is 1½ inches deep, 1 inch wide and extends from stile to stile.

Positioned within the aformentioned cavity is the roller assembly 30 of this invention. It comprises a modified "U" shaped member 31 having a pair of legs or sides 32 and 33 best seen in FIG. 2, which journal a roller 34 on a shaft 35 which extends between the sides 32 and 33. The sides 32 and 33 include inwardly depending or extending regions 36 and 40 which are closely aligned with the side walls of the roller and minimize the overall length of the shaft 35. The sides or legs 32 and 33 each include upwardly extending respective feet 41 and 42 including planar upper edges, the purpose of which will be more apparent in connection with the description of FIG. 3. The legs 32 and 33 of the bracket are joined by a bridge portion 43 including a notch 44 at its upper end and additionally includes an aperture therethrough for the adjusting screw 50 which is used as described in FIGS. 3 and 4 to adjust the amount of extension of the roller 34 below the lower level of the walls 25 and 26 and thus the height of the window or door.

Figure 2:
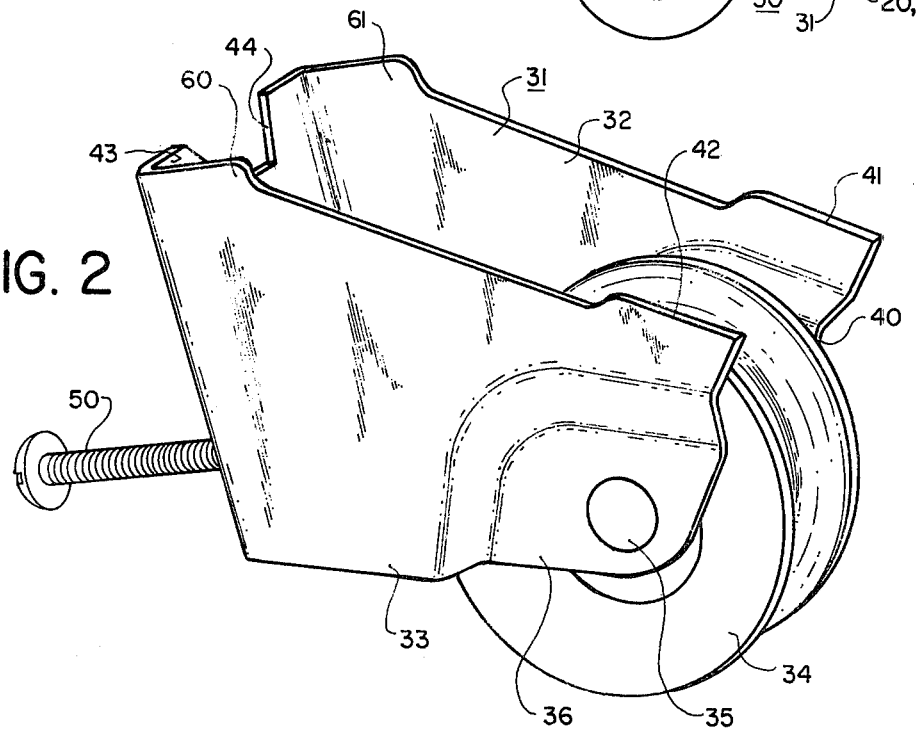
FIG. 2 is a perspective view of the roller assembly of this invention.

Referring now momentarily to FIG. 7, the bottom view of the roller assemblies of FIGS. 1 and 2, a captured nut 51 retained by an integral tab 52 of the end bridge 43 serves the purpose of allowing the easy adjustment of screw 50 from the exterior of the door as shown in FIG. 1, to change the degree of extention of the roller 34. Thus, from the examination of FIGS. 1, 2 and 7, it may be seen that the roller assembly includes the U shaped bracket 31, roller 34 and its axle or shaft 35, adjusting screw 50 and its captured nut 51. These elements, all preassembled, constitute the roller assembly.

It also should be noted that the roller assembly 30 achieves adjustability downward to elevate the door or window and upward and out of the way for lowering the window or door, and additionally, conceivably for storage or transit the assembly employs the two adjoining walls 20 and 21 of the stile 11 and web 22 of the rail 12.

In as much as virtually all aluminum or metal frame doors and windows contain as integral parts thereof the exact or equivalent to the ribs 20 and 21 and the web 22, the roller assembly of this invention may be installed in virtually any window or door frame having a cavity of sufficient size to receive the assembly 30. The assembly of FIGS. 1, 2 and 7 is approximately one half the number of parts of most assemblies and involves only the adjustment of the entire assembly and no adjustment of internal parts which might become jammed through misuse or improper installation. It must be recognized that the adjustment upward and downward of a window or door is not a common adjustment and is usually only made at the time of installation. Consequently, the minimization and simplification of the assembly and the adjustment mechanism aids greatly in the reduction of costs and repeated cycling of operation is not a concern.

Now referring to FIGS. 3 and 4, the two typical positions of the assembly 30 may be seen. In FIG. 3, the roller assembly 30 is shown in its fully upward adjusted position with the screw 50 loosened to its full extent. When in this position, the upper edge of the feet 41 and 42 rest against the underside of web 22 while the upper corner of the bridge 43 of the roller assembly 30 rests against the walls 21 and 22 of the stile 11. A corner 60 of the side wall 33 and its matching corner 61 of the side wall 32 appearing in FIG. 2 also rests against the ribs 21 and 22 of the stile 11. These surfaces present adequate support for the door and if a particularly heavy door is to be supported requiring additional strength, the feet 41 and 42 may be joined by an integral or overlapping web portion to provide additional support surface. From experimentation to date, the need for such second web does not need to be present.

Now referring to FIG. 4, when the screw 50 is tightened by clockwise movement, it draws the assembly 30 closer to it and in so doing causes the assembly 30 to pivot generally around the corner "C" with the feet 42 and 41 no longer in contact with the web 22 and with the contact at point 60 and 61 and the bridge 43 moved slightly but still engaging the under side of web 22 and the ribs 21 and 22 of the stile 11. Further tightening of the screw 50 up to the point where the angle between the bridge 43 and the ribs 21 and 22 approaches zero produces the maximum extent of rotation of the assembly 30. When the maximum extent of rotation is achieved, the outer wall of bridge 43 is coplanar with the ribs 21 and 22 and the planar upper surface 65 becomes coplanar with the underside of the web 22. In these circumstances, the right angle of the roller assembly 30 matches the right angle of corner "C" and a rigid frame and roller assembly is achieved. In this position, the roller assembly actually enhances the strength of the corner "C". Backing off the screw 50 allows the roller assembly to be withdrawn into the rail 12. In normal installation procedures, the roller assembly can be installed after assembly of the door and actually as it is to be placed in the house or apartment. This is possible by the addition of a slot 70 at the bottom of stile 11 as shown in FIG. 6. In such case, the screw 50 is slipped upward in the slot 70 and then tightened to rotate the roller assembly 30 into its required position. The screw may merely be tightened until it reaches a neutral stop at the time angle theta of FIG. 4 reaches zero, at which time the roller assembly is at its maximum extension outward and the assembly is in its greatest strength adding relationship to the frame of the door or window.

The roller assembly of this invention is not limited to a single roller as appears in FIGS. 1 through 7. Instead, it can be used with a pair of side by side rollers and in such case, the maximum extent of adjustability is enhanced since the screw 50 is not limited in length by interference with the roller 34 as shown in the first 7 FIGS. In this case a pair of side by side rollers 134 and 135 are each journaled from the U shaped member 131 on their common shaft 135A. The operation of the double roller version of FIG. 8 is the same as the single roller of FIGS. 1 through 7, and FIGS. 1, 3 and 4 illustrate equally well the relative positioning and operation of the double roller assembly of FIG. 8.

Figure 9:
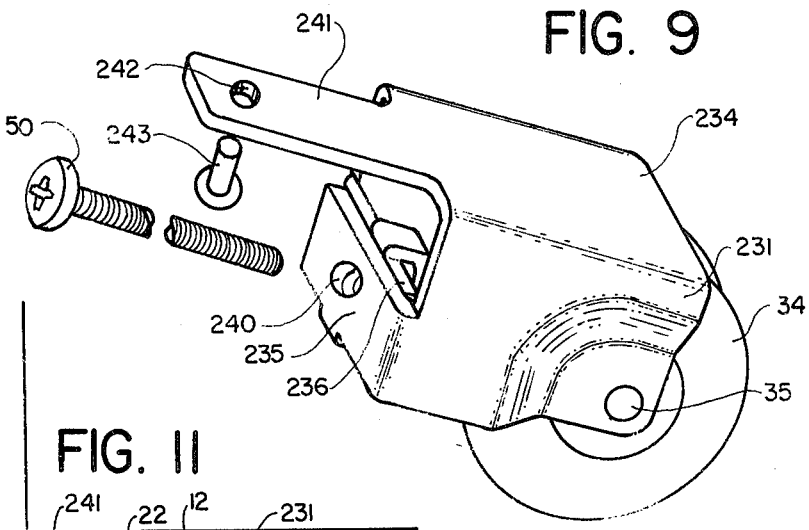
FIG. 9 is a perspective view of a second alternate embodiment of this invention.
Figure 10:
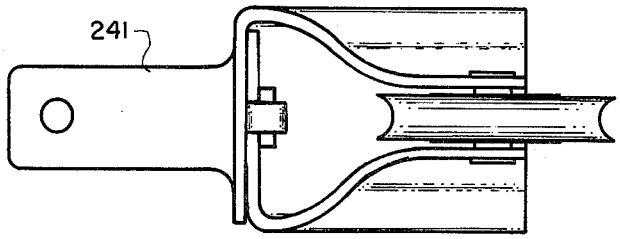
FIG. 10 is a bottom view of the embodiment of FIG. 9.

Now referring to FIGS. 9 and 10, an alternate embodiment of this invention may be seen employing a U shaped member 231 which journals a roller 34 on a shaft 35 and includes an inner connecting bridge portion 234 at the top thereof. The U shaped member includes a pair of overlapping arms 235 and 236 with a mating opening therethrough 240 for receiving the end of the screw 50. The arms 235 and 236 may hold a captured nut or the opening 240 may be threaded for engagement with the threads of the screw 50. The assembly 231 includes an outward extending tab 241 which is integral with the bridge 234 and includes an opening therethrough 242 which cooperates with a rivet or other fastener 243 to be secured to the upper wall of the cavity in a rail such as the web 22 of the rail 12 of FIGS. 1, 3 and 4. The rivet 243 may be replaced by a self tapping screw or other type of fastener which is designed to permanently secure the outer most end of the tab 241 to the rail of the door or window. The screw 50 again extends through the stile of the door such as stile 11 of FIGS. 1 and 2, and may be tightened in the same manner as in FIGS. 1 through 7. This embodiment has a further advantage not heretofore discussed. This is that the tab 241 is a spring element and provides a degree of spring cushioning of the door on its roller 34. This spring mounting is accomplished with no additional parts and employs only the tab 241 which functions both for adjustment and for spring mounting. With possible deformation over years of use if the tab 241 is gradually deformed upward, it is possible merely by further adjustment of the screw 50 to bring the roller back to the desired position.

One of the advantages of the embodiment of FIGS. 9 through 11 is again the simplicity which is inherent in the entire concept of roller assemblies in accordance with this invention. It creates one additional part, namely the addition of the rivet or screw fastener 243 for an additional spring function.

Figure 11:
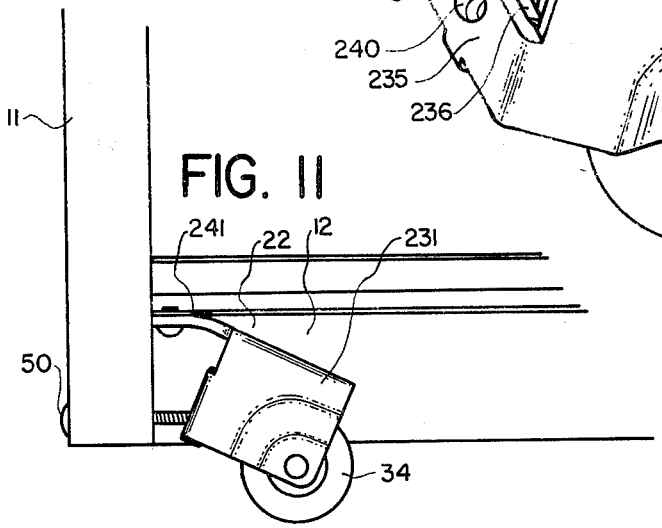
FIG. 11 is a side elevational view partly broken away of the embodiment of FIG. 9 installed in a door assembly.
Figure 12:
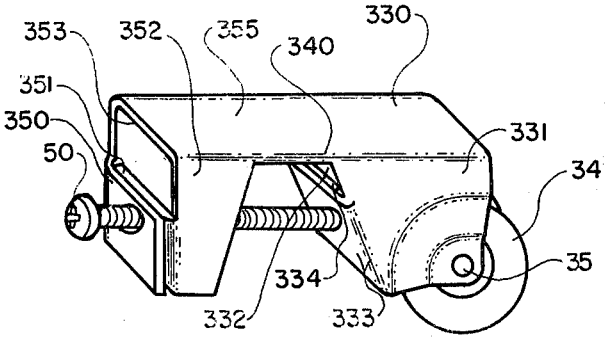
FIG. 12 is a perspective view of another embodiment of this invention.
Figure 13:
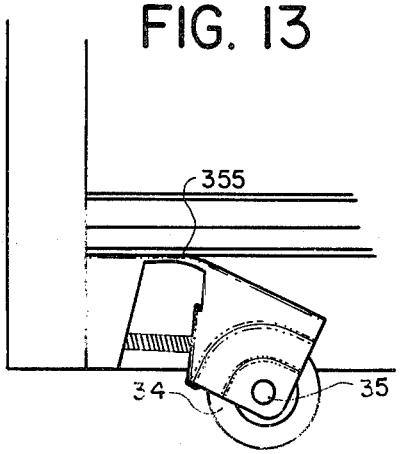
FIG. 13 is a side elevational view of the alternate embodiment of FIG. 12 adjusted in lowered position.

For heavier duty applications than is desired for the assembly of FIGS. 9 through 11, the embodiment of FIGS. 12 and 13 is preferred. In this case, the body 330 is generally inverted channel shaped including a pair of side walls 331 and 332 which journal the roller 34 on a shaft 35. The side walls 331 and 332 are strengthened by the cross arms 333 and 334 comparable to the arms 235 and 236 of FIG. 9, and provide a box like structure for supporting the roller 34. An opening 340 comparable to opening 240 in FIG. 9 receives screw 50 for adjustment. The screw 50 extends through a pair of arms 350 and 351 which are integral with a second pair of depending sides 352 and 353 which are integral with a second pair of depending sides 352 and 353 respectively, to form a second box like structure joined to the roller holding portion of the assembly by a web 355. This web extends across the full width of the top of the roller assembly to add greater strength than the narrow tab 241 of the embodiment of FIG. 9. This web 355, however, may similarly be deformed as shown in FIG. 13 to adjust the roller 34 downward. This embodiment again provides a degree of spring mounting of the door which of course is limited by the resilient properties of the web 355.

In each of the foregoing embodiments, it is apparent that the roller assembly cooperates with the rail and stile member and by either rotation or deformation in response to screw tightening, provides extension of the roller 34. Although intended for single time operation, the inherent nature of the type of adjustment which is made allows repeated adjustments as may be required. In addition to the cooperation between the stile and rail, the roller assemblies, as described above, involve extreme degree of simplicity.

The above described embodiments of this invention are merely descriptive of its principles and are not to be considered limiting. The scope of this invention instead shall be determined from the scope of the following claims including their equivalents.

What is claimed is:

1. A door or window assembly including a vertical stile and a horizontal rail at substantially a right angle corner, said rail defining an open bottom cavity;

a roller assembly including a roller journaled therein and partially extending out of said assembly to provide a rolling support surface for said assembly;

said roller assembly having a thickness generally corresponding to the transverse dimension of said cavity;

said roller assembly including an end region spaced from said roller and constituting an area for pivotal movement;

said end region defining a right angle corner whereby at one degree of adjustment said right angle corner matches the right angle corner defined by said stile and rail;

an adjusting screw extending through said assembly and engaging said roller assembly for pivoting the roller assembly generally about the corner defined by the stile and rail by contact with said stile and rail in all positions of adjustment to change the degree of extension of the roller from the cavity defined by the rail;

wherein said roller assembly is generally U shaped and includes at least a pair of integral feet adjacent to the end journaling the roller acting as stops for the full upward adjusted position of the roller and supports for the rail when in such position;

wherein said roller assembly includes a second pair of surfaces adjacent to the corner nearest the corner defined by the rail and stile whereby said latter surfaces remain in contact with said rail regardless of the degree of extension of the roller and constitutes supports therefore.

2. The combination in accordance with claim 1 wherein the roller assembly includes a pair of sides and a bridge portion therebetween and said last pair of surfaces define a generally right angle whereupon said right angle corresponds to the corner defined by said rail and stile and wherein at one degree of adjustment of said adjusting screw, said roller assembly is then in surface contact with both said stile and said portion of the rail defining said cavity for effective load transfer to said roller.

* * * * *